US009649247B2

(12) United States Patent
Tsai

(10) Patent No.: US 9,649,247 B2
(45) Date of Patent: May 16, 2017

(54) MASSAGE DEVICE FOR BREASTS

(71) Applicant: Ming-Wei Tsai, New Taipei (TW)

(72) Inventor: Ming-Wei Tsai, New Taipei (TW)

( * ) Notice: Subject to any disclaimer, the term of this patent is extended or adjusted under 35 U.S.C. 154(b) by 316 days.

(21) Appl. No.: 14/470,983

(22) Filed: Aug. 28, 2014

(65) Prior Publication Data

US 2016/0058645 A1 Mar. 3, 2016

(51) Int. Cl.
*A61H 15/00* (2006.01)
*A61H 7/00* (2006.01)

(52) U.S. Cl.
CPC ..... *A61H 15/0078* (2013.01); *A61H 7/007* (2013.01); *A61H 2015/0042* (2013.01); *A61H 2201/0153* (2013.01); *A61H 2201/0207* (2013.01); *A61H 2201/0235* (2013.01); *A61H 2201/1215* (2013.01); *A61H 2201/165* (2013.01); *A61H 2201/1619* (2013.01); *A61H 2201/1661* (2013.01); *A61H 2205/082* (2013.01)

(58) Field of Classification Search
CPC . A61H 1/00; A61H 1/003; A61H 1/08; A61H 7/00; A61H 7/002; A61H 7/003; A61H 7/004; A61H 7/005; A61H 7/007; A61H 2007/009; A61H 2201/02; A61H 2201/0207; A61H 2201/0221; A61H 2201/0228; A61H 2201/165; A61H 2201/1654; A61H 2201/1671; A61H 2201/1673; A61H 2205/082
See application file for complete search history.

(56) References Cited

U.S. PATENT DOCUMENTS 1,899,208 A * 2/1933 Murphy ..... A61H 15/0085 601/113
2,258,931 A * 10/1941 Heer ..... A61H 15/0085 601/113
3,035,571 A * 5/1962 Jones ..... A61H 23/02 601/46
3,077,878 A * 2/1963 Baulard-Cogan .. A61H 15/0085 601/113
RE30,500 E * 2/1981 Springer ..... A61H 15/02 601/131
5,447,491 A * 9/1995 Bellandi ..... A61H 7/001 601/108
6,733,466 B2 * 5/2004 Huang ..... A61H 23/0254 601/101

(Continued)

*Primary Examiner* — Steven Douglas
(74) *Attorney, Agent, or Firm* — Lin & Associates Intellectual Property, Inc.

(57) ABSTRACT

A breast massage device includes a main body; a drive unit installed within the main body; and a massage disk mounted on the main body and coupled with the drive unit so as to be driven rotatably thereby. The massage disk has a central axis, a concave surface for covering a breast, and a periphery confining the concave surface, wherein the periphery has a highest point and a lowest point located at two opposite sides of the central axis such that a portion of the concave surface extending from the highest point toward the central axis is longer in curved distance than another portion of the concave surface extending from the lowest point to the central axis. A plurality of massage elements are mounted rotatably on the concave surface such that the massage elements are rotatable relative to the concave surface when the drive unit is activated.

10 Claims, 13 Drawing Sheets

(56) References Cited

U.S. PATENT DOCUMENTS

| | | | | |
|---|---|---|---|---|
| 6,837,861 | B2 * | 1/2005 | Lin | A61H 23/0254 601/101 |
| 8,777,881 | B2 * | 7/2014 | Tsai | A61H 7/004 601/112 |
| 2007/0049851 | A1 * | 3/2007 | Lin | A61H 23/0263 601/70 |
| 2009/0118573 | A1 * | 5/2009 | Tsao | A61F 5/41 600/38 |
| 2010/0312156 | A1 * | 12/2010 | Wu | A61H 7/005 601/112 |
| 2013/0131562 | A1 * | 5/2013 | Wu | A61H 7/007 601/112 |
| 2014/0094722 | A1 * | 4/2014 | Wu | A61H 23/0263 601/14 |
| 2014/0221879 | A1 * | 8/2014 | Chu | A61H 7/007 601/18 |

* cited by examiner

MASSAGE DEVICE FOR BREASTS

BACKGROUND OF THE INVENTION

1. Field of the Invention

The present invention relates generally to a massage device, and more particularly to a massage device for breasts, specially the device is capable of providing hot massage effects to the breasts of a user.

2. The Prior Arts

Breasts are special and distinguishing characteristic of women. It is often considered as the standard beauty for all women. In the westerner points of view, the bustier the breast is, the more attraction of woman is increased. As the view of world changes, majority of the countries in the world, including our country, gradually accept the westernized view in the concept of aesthetic.

According to the current medical views, several suggestions are raised that partially massaging the breasts can increase the blood circulation and irritate inner metabolism so as to stimulate the reaction of breasts, which, in turn, results in the growth of breasts. It is also said that the massage of breasts can get rid of chest tightness.

A conventional breast massage device generally includes a motor or low voltage generating unit for stimulating part or at single spot of the breast. The massage is done only at the exterior portion of the skin such that the massage effect cannot penetrate into the deeper layer of the skin, which in turn, cannot stimulate the blood circulation. Under this condition, the majority of women does not rely on or trust the conventional breast massage device.

SUMMARY OF THE INVENTION

The objective of the present invention is to provide a massage device, especially for woman's breasts, which can get rid of the aforesaid disadvantages resulted from the use of the conventional breast massage device.

One specific feature resides in that through conventional mechanical driving structure and circuit paths, the massage device of the present invention can provide massage effects deep into the interior of the breasts in such a manner that the user being massaged can feel more than two types of massage actions so as to stimulate the blood circulation of the breasts, which, in turn, enhances the growth of breast and simultaneously softens those hard particles in the breasts, thereby improving the health thereof.

The breast massage device of the present invention accordingly includes a main body; a drive unit installed within the main body; and a massage disk mounted on the main body and coupled with the drive unit so as to be driven rotatably thereby, the massage disk having a central axis, a concave surface for covering a user's breast and a periphery confining the concave surface, wherein the periphery has a highest point and a lowest point located at two opposite sides of the central axis such that a portion of the concave surface extending from the highest point toward the central axis is longer in curved distance than another portion of the concave surface extending from the lowest point to the central axis, and a plurality of massage elements mounted rotatably on the concave surface such that the massage elements are rotatable relative to the concave surface upon activation of the drive unit. Owing to the asymmetric inclination of two portions of the concave surface, the massage disk provides waveform massage effects when the same is driven rotatably by the drive unit, which is different from a conventional massage device that provides two dimensional massage effects only.

The breast massage device of the present invention further includes a plurality of heat generating elements and circuits disposed below the massage disk. Preferably, thermistor, filaments, bulbs can serve as the heat generating elements which become hot upon passage of current through the circuits so as to generate thermal heat at the tips of the massage elements so as to warm up the user's breasts and at the same time providing massage actions to the user's breasts.

In order to enhance the massage effects of the massage elements, the materials for construction of the massage elements are selected from a group consisting of titanium, germanium, magnetic stone, Nano, infrared-emitting substance and ceramics.

In one embodiment of the present invention, each of the massage elements is shaped like a ball (glass ball). In another embodiment, a plurality of protrusion elements serving as the massage elements are disposed stationarily on the concave surface such that each of the protrusion elements is curved and protruded outward from the concave surface of the massage disk and has a narrow first end and a large second end, which increases gradually in height, width and surface area from the narrow first end toward the large second end. More preferably, two of the protrusion elements are disposed stationarily and annularly on the concave surface in an asymmetric manner with respect to a central axis or an eccentric axis of the massage disk so as to provide the optimal massage actions (such as rubbing and kneading) upon rotation of the massage disk.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

Figure 1:
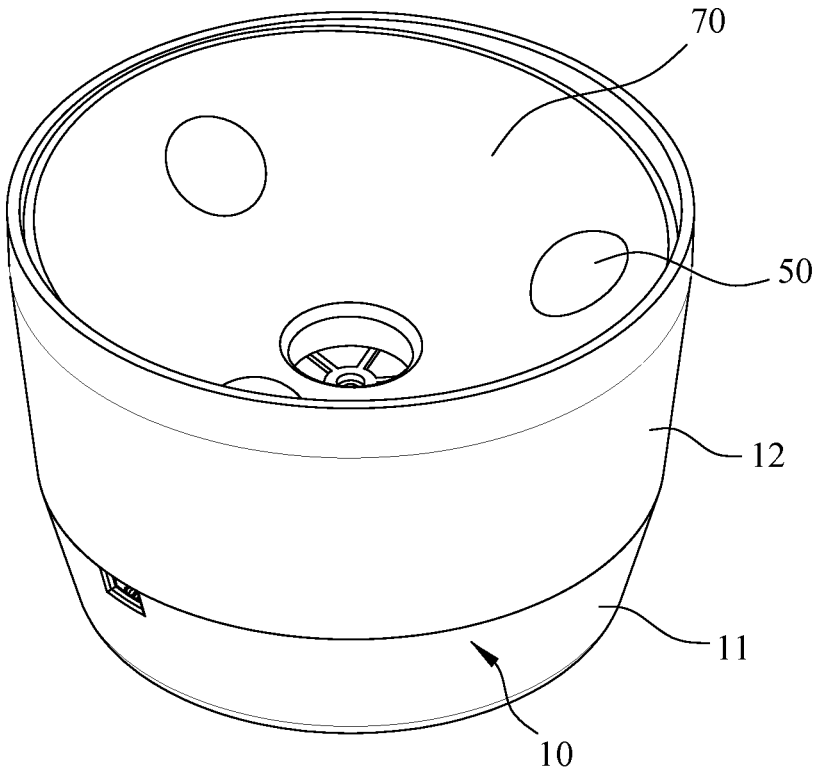
FIG. 1 shows a perspective view of the first embodiment of a breast massage device of the present invention.
Figure 1A:
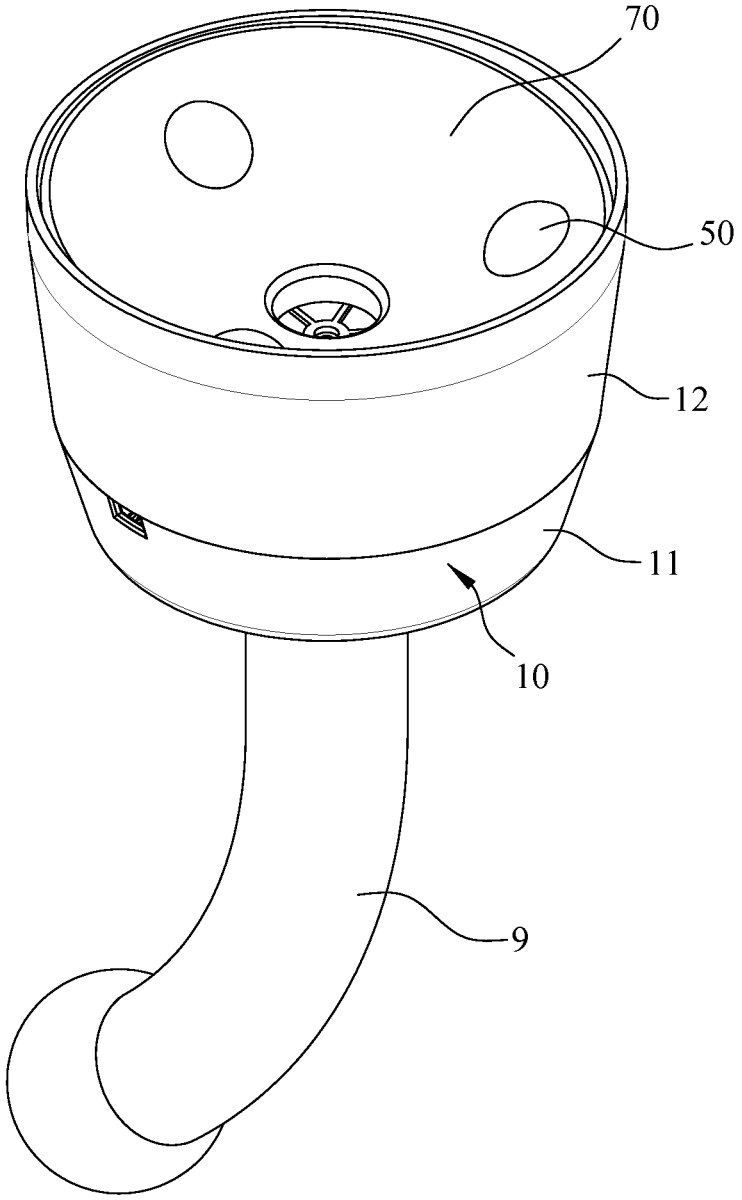
FIG. 1A shows a perspective view of the first embodiment of the breast massage device of the present invention provided with a handle.
Figure 2:
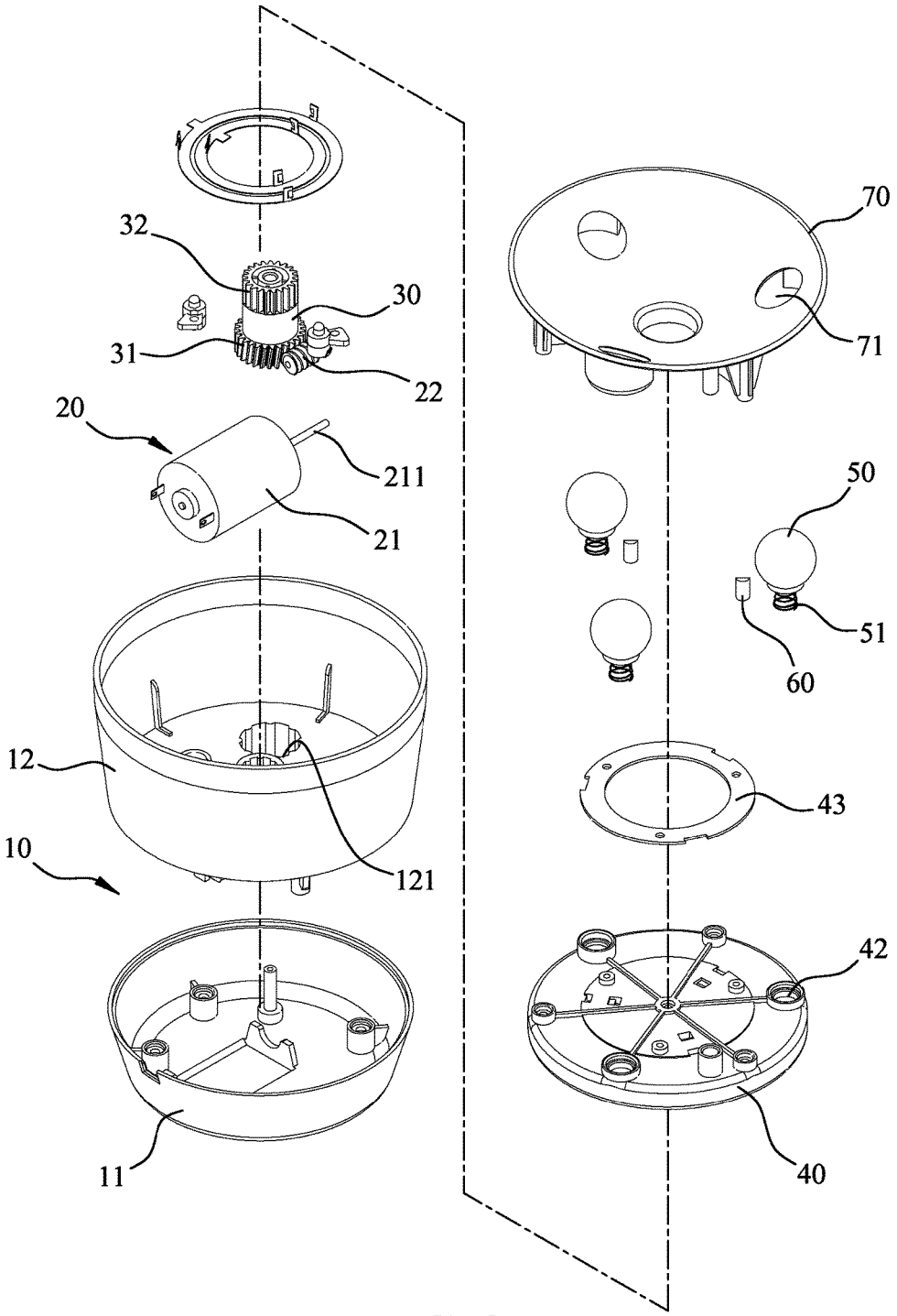
FIG. 2 shows an exploded view of the first embodiment of the breast massage device of the present invention.
Figure 2A:
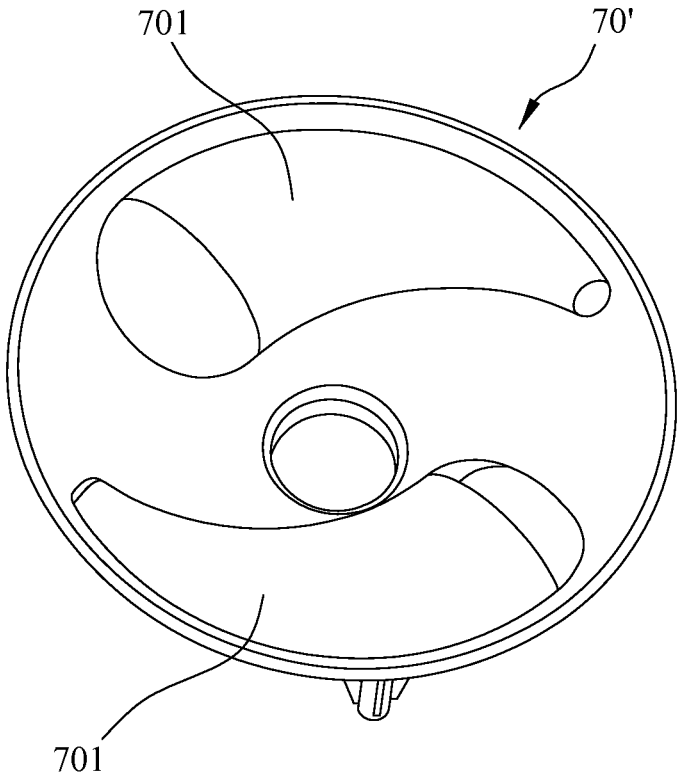
FIG. 2A shows a massage disk employed in the breast massage device of the present invention.
Figure 2B:
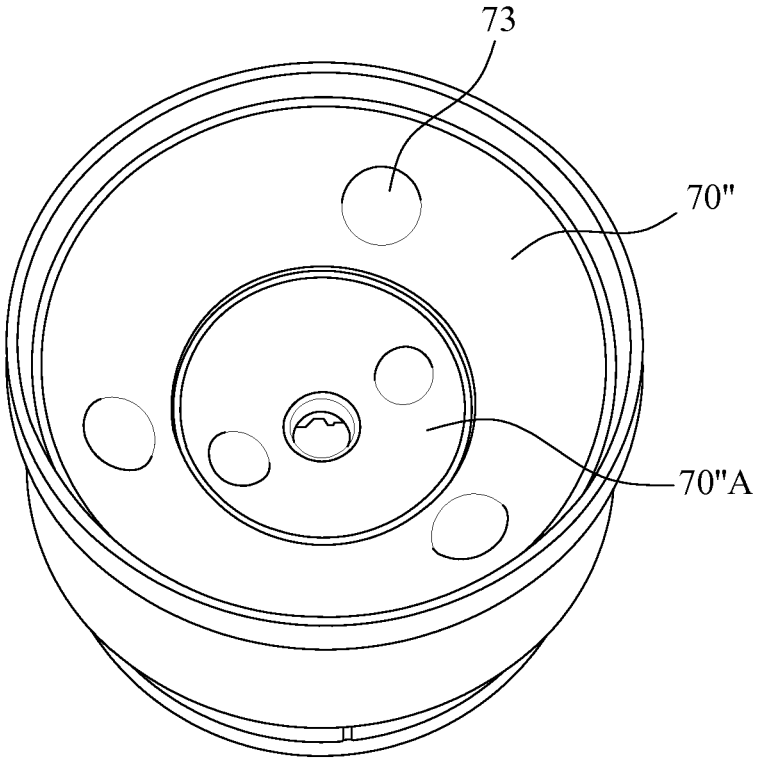
FIG. 2B shows another massage disk employed in the breast massage device of the present invention.
Figure 3:
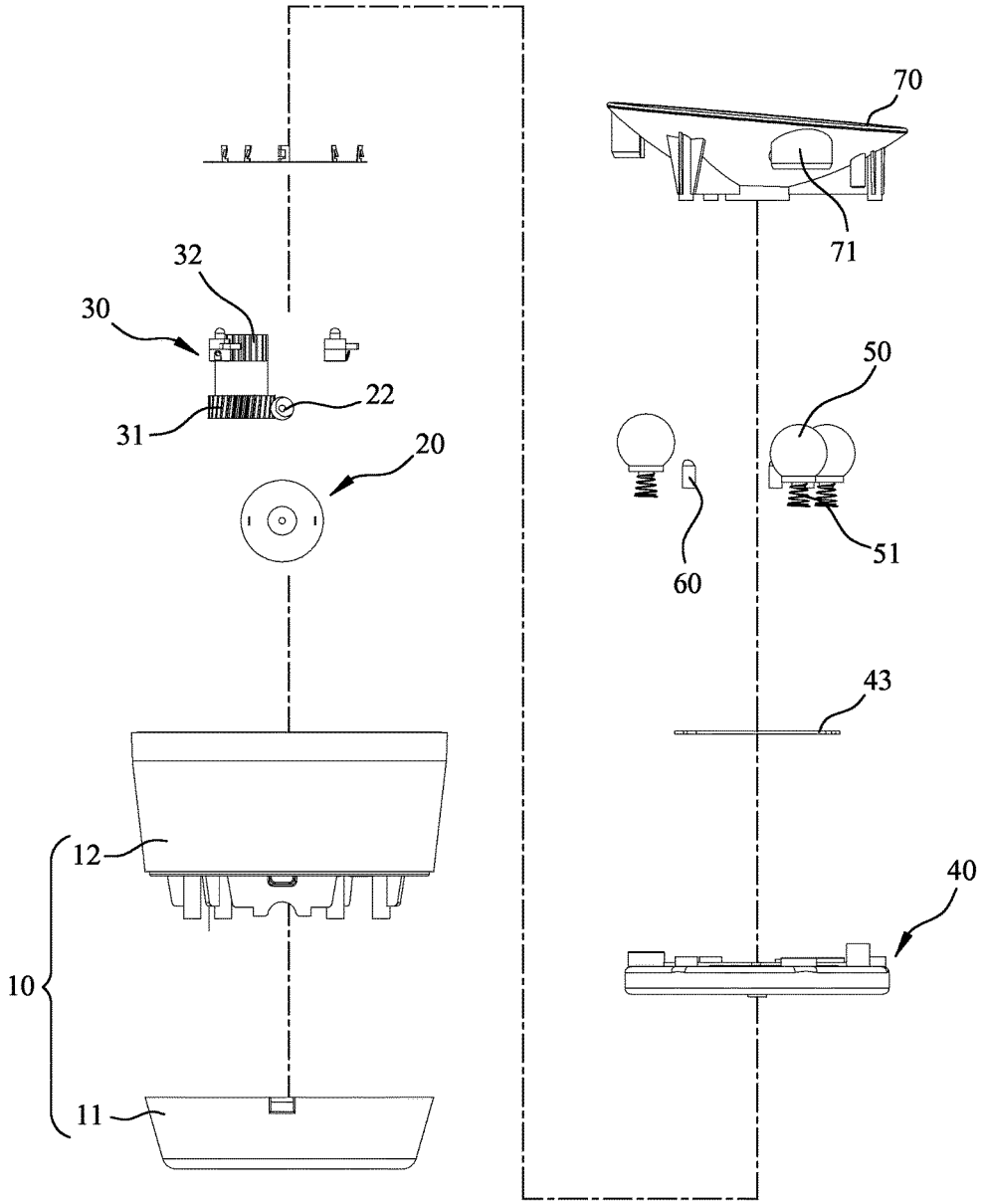
FIG. 3 shows an exploded and lateral view of the first embodiment of the breast massage device of the present invention.
Figure 4:
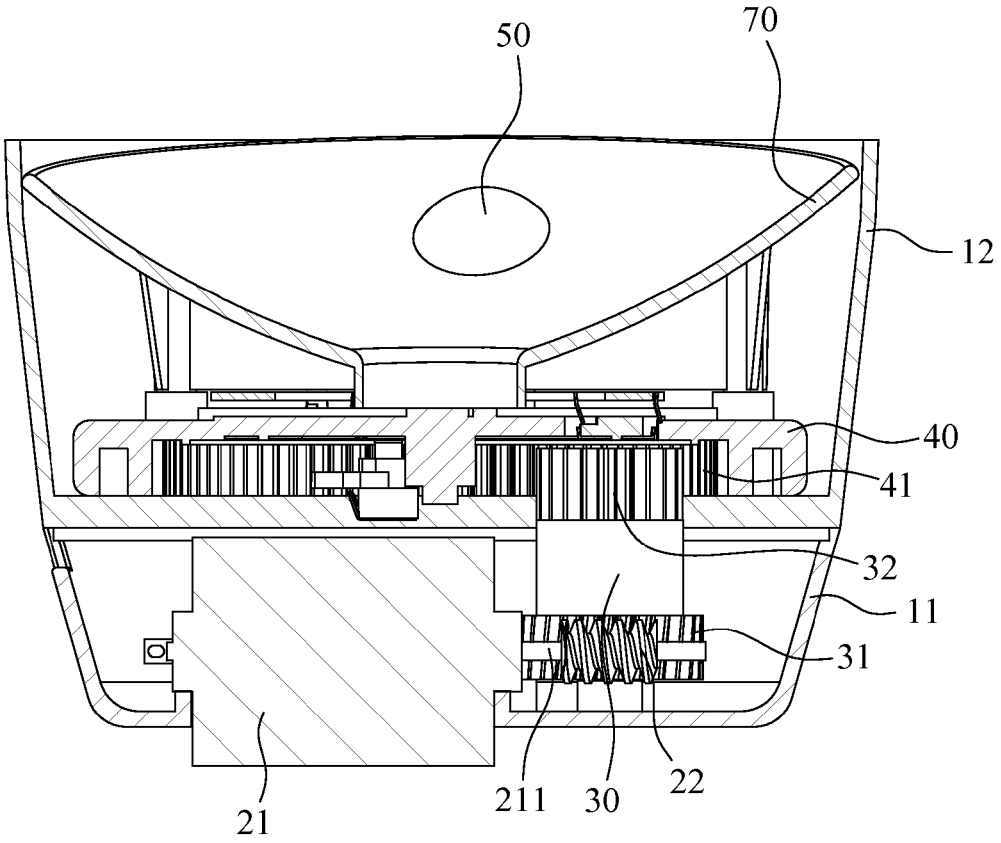
FIG. 4 is a cross-sectional view of the first embodiment of the breast massage device of the present invention.

Referring to FIGS. 1 to 4, wherein FIG. 1 shows a perspective view of the first embodiment of a breast massage device of the present invention; FIG. 1A shows a perspective view of the first embodiment of the breast massage device of the present invention provided with a handle; FIG. 2 shows an exploded view of the first embodiment of the breast massage device of the present invention; FIG. 2A shows a massage disk employed in the breast massage device of the present invention; FIG. 2B shows another massage disk employed in the breast massage device of the present invention; FIG. 3 shows an exploded and lateral view of the first embodiment of the breast massage device of the present invention; and FIG. 4 is a cross-sectional view of the first embodiment of the breast massage device of the present invention. As illustrated, the breast massage device of the present invention includes a main body 10, a drive unit 20, a transmission gear set 30, a rotary base 40, a plurality of massage elements 50, a plurality of light sources 60 and a massage disk 70.

The main body 10 includes a bottom part 11 defining a bottom chamber and an upper part 12 that is disposed securely above the bottom part 11 and that defines an upper chamber, which is communicated spatially with the bottom chamber via a through hole 121 (see FIG. 2).

The drive unit 20 is installed in the bottom chamber of the bottom part 11, includes a motor 21 having a drive shaft 211, a drive axle 22 sleeved securely on the drive shaft 211.

The transmission gear set 30 is installed within the through hole 121 of the main body 10, has a lower gear part 31 extending into the bottom chamber in such a manner so as to be engaged with the drive axle 22 so that the lower gear part 31 is driven upon activation of the motor 21. The gear set 30 further has an upper gear part 32 integrally formed with the lower gear part 31 and extending into the upper chamber of the upper part 12.

The rotary base 40 is disposed rotatably in the upper chamber, and has at least one driven wheel 41 (see FIG. 4) formed on a lower side surface thereof and engaged with the upper gear part 32 of the gear set 30 such that the rotary base 40 is driven upon activation of the motor 21. Preferably, the rotary base 40 is shaped like a circular disk in this embodiment. The upper side surface of the rotary base 40 is formed with a plurality of retention recesses 42 and a light-retention plate 43 located interior of the retention recesses 42.

The plurality of massage elements 50 are disposed rotatably within the retention recesses 42 of the rotary base 40. Each of the massage elements 50 is shaped like a ball. The massage device of the present invention further includes a plurality of biasing elements 51 (springs) disposed within the retention recesses 42 respectively beneath the massage elements 50 for resiliently cushioning the massage elements 50. In order to enhance the massage effects of the massage elements 50, the materials for construction of the massage elements 50 are selected from a group consisting of titanium, germanium, magnetic stone, Nano, infrared-emitting substance and ceramics.

The plurality of light sources 60 are mounted on the light-retention plate 43. In this embodiment, Light Emitting Diodes (LED) serve as the light sources 60.

The massage disk 70 is disposed in the upper chamber above the rotary base 40, has a lower portion fastened securely with the rotary base 40 such that the massage disk 70 and the rotary base 40 are driven simultaneously upon activation of the motor 21. As best illustrated in FIG. 3, the massage disk 70 has a concave surface that is used for covering a breast and that is contoured to possess at least two areas extending in an asymmetric inclination manner relative to each other with respect to the concave surface. Resilient transparent or semi-transparent materials can be selected for forming the massage disk 70. The massage disk 70 is preferably formed with a plurality of exposure holes 71 via which the massage elements 50 are exposed to an exterior of the massage disk 70 so as to provide massage actions.

As illustrated in FIG. 2A, in one embodiment of the present invention, the massage disk 70 has a central axis and a concave surface an external surface for covering a user's breast. The massage disk 70 further has a periphery confining the concave surface, wherein the periphery has a highest point and a lowest point located at two opposite sides of the central axis such that a portion of the concave surface extending from the highest point toward the central axis is longer in curved distance than another portion of the concave surface extending from the lowest point to the central axis (see FIG. 1). A plurality of protrusion elements 701 disposed stationarily on the concave surface and extending annularly around the central axis of the concave surface such that each of the protrusion elements 701 is curved and protruded outward from the concave surface and has a narrow first end and a large second end, which increases gradually in height, width and surface area from the narrow first end. In other words, two of the protrusion elements 701 look like a Tai-ji diagram (a Chinese martial art symbol) when viewed from a top side. Preferably, the two protrusion elements 701 are located in an asymmetric manner relative to an eccentric axis or a central axis of the massage disk 70.

As illustrated in FIG. 2B, the concave surface of the massage disk 70" is the same as the previous one such that a detailed description thereof is omitted herein for the sake of brevity. It is to note that in this embodiment, the massage disk 70" is shaped like a large wheel and defines a central axis and a smaller massage disk 70"A is mounted concentrically with the massage disk 70" within the upper chamber above the rotary base 40 in such a manner the two massage disks 70", 70"A are driven simultaneously in transverse directions relative to each other upon activation of the motor 21.

When the massage device of the present invention is in use, the massage disk 70, 70' or 70" are driven upon activation of the drive unit 20 such that rotation of the massage disk 70, 70' or 70" provide waveform massage actions on the breasts owing to the asymmetric inclination structure of two portions of the concave surface, thereby resulting in rubbing, kneading and pinching massage actions relative to the breasts covered by the external concave surface of the massage disk 70, 70' or 70".

Since the plurality of heat generating elements (like thermistor, filaments, bulbs) and circuits are disposed below the massage disk, the same emit radiation once current flows therethrough such that the radiation beams are emitted from the tips of the massage elements 50 or the protrusions 701 into the breasts such that the user may feel warming effects at her own breasts.

Preferably, in order to enhance the massage effects of the massage elements 50 for the user, the materials for construction of the massage elements 50 are selected from a group consisting of titanium, germanium, magnetic stone, Nano, infrared-emitting substance and ceramics.

Figure 5:
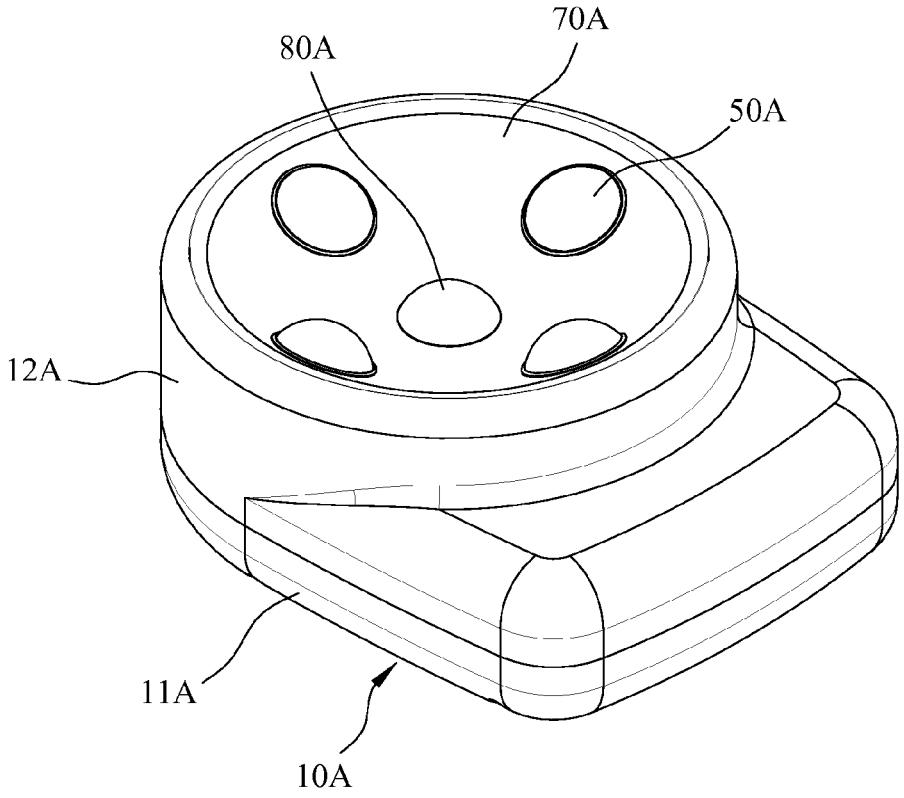
FIG. 5 shows a perspective view of the second embodiment of the breast massage device of the present invention.
Figure 6:
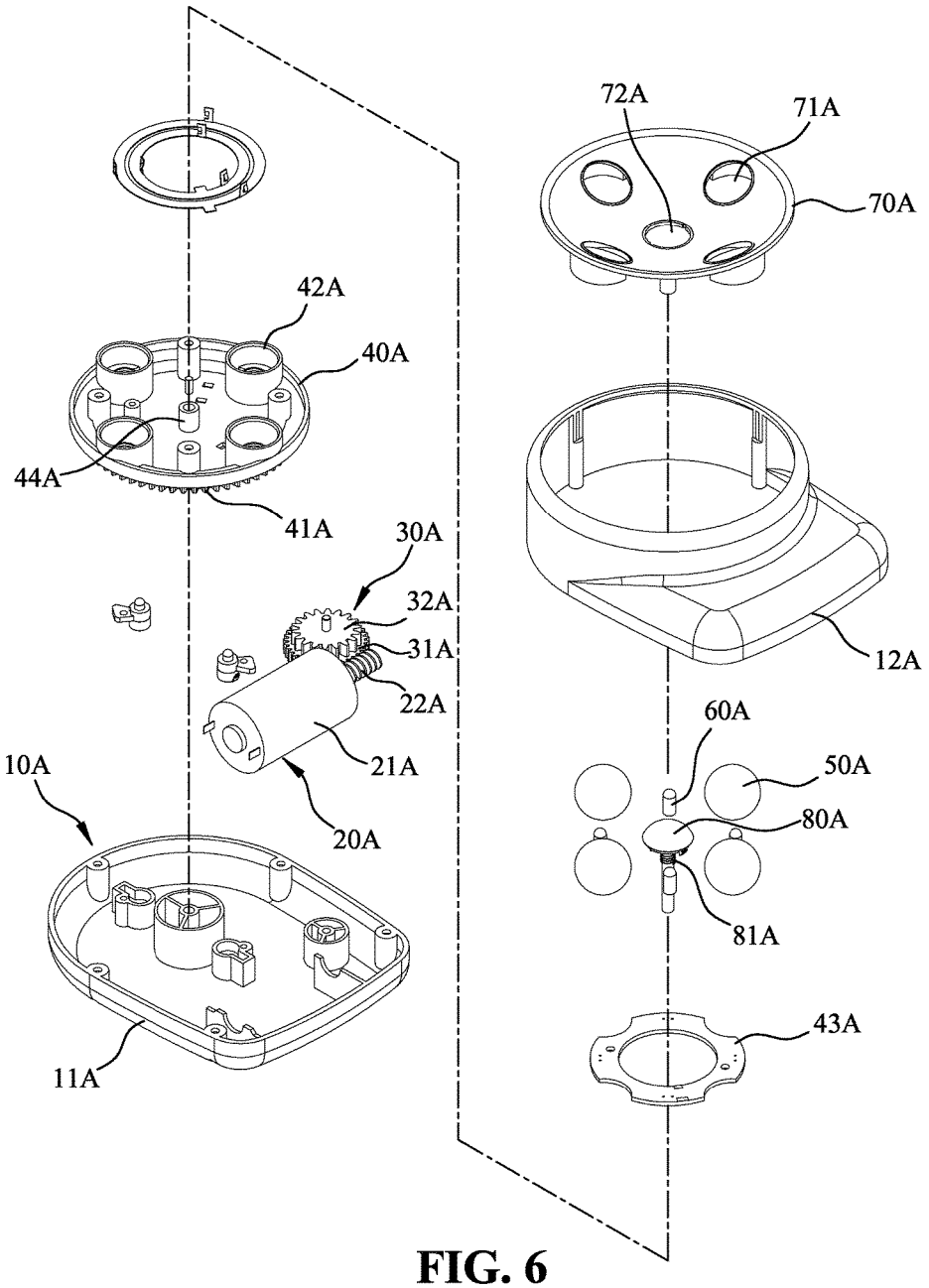
FIG. 6 shows an exploded and perspective view of the second embodiment of the breast massage device of the present invention.
Figure 7:
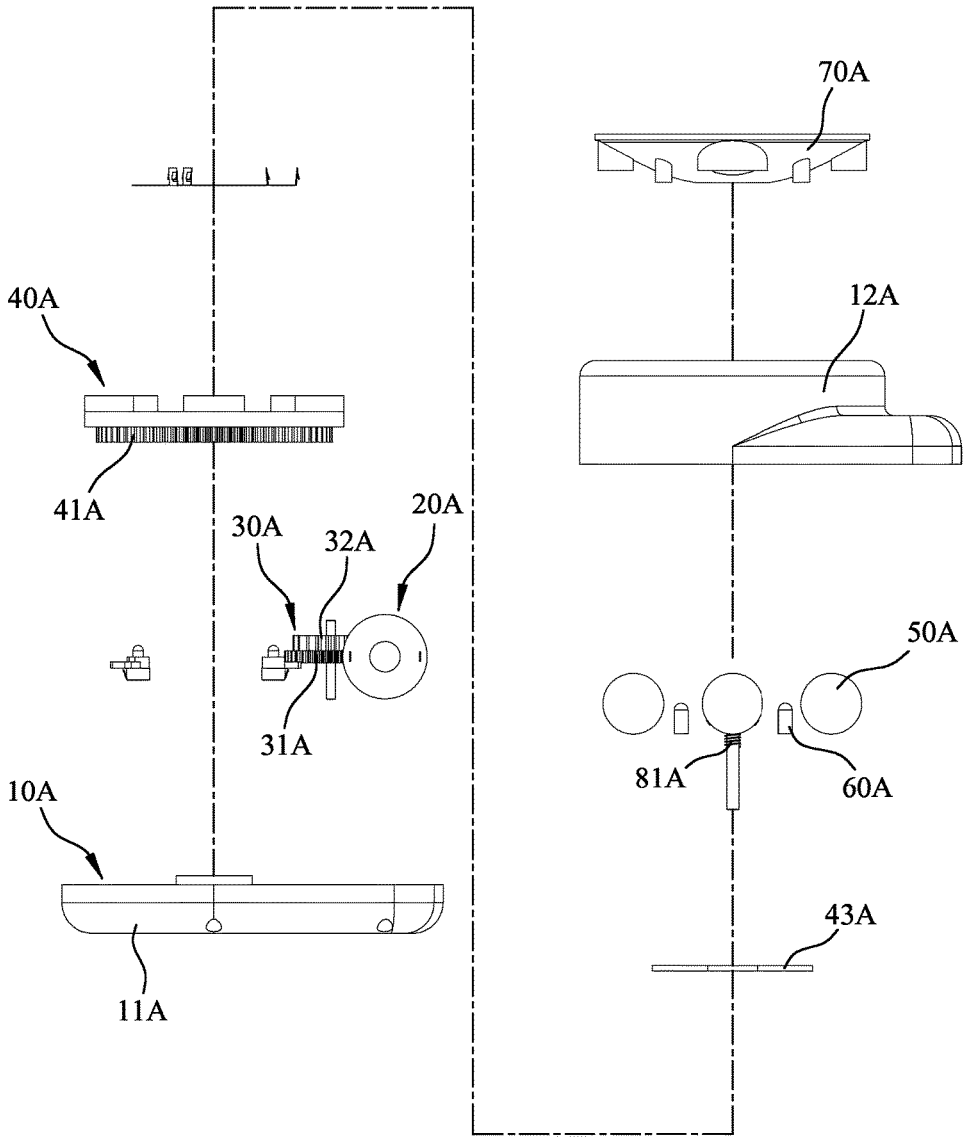
FIG. 7 shows an exploded and lateral view of the second embodiment of the breast massage device of the present invention.
Figure 8:
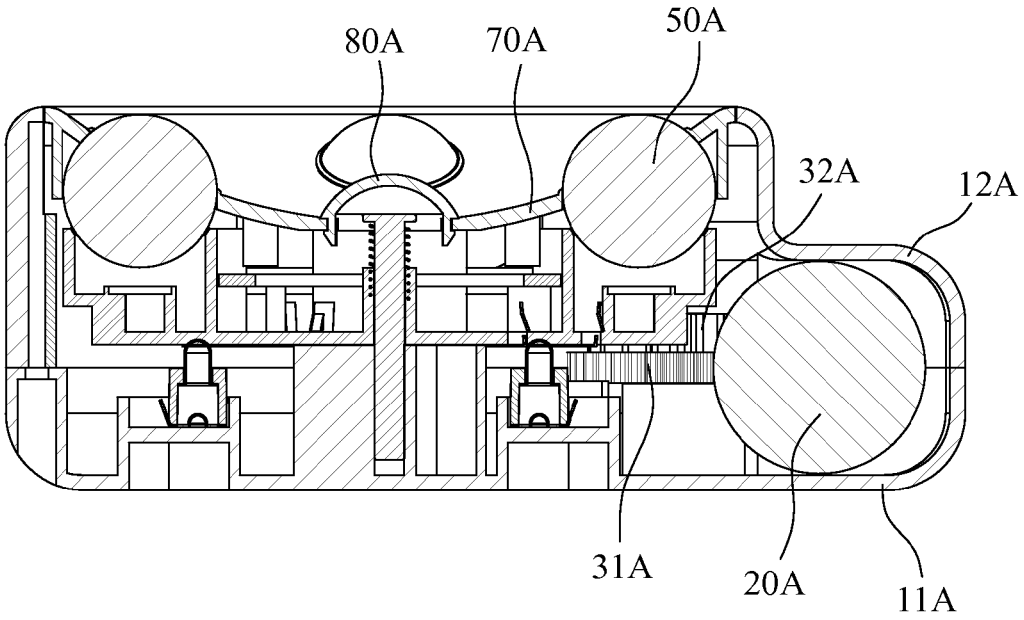
FIG. 8 is a cross-sectional view of the second embodiment of the breast massage device of the present invention.

Referring to FIGS. 5 to 8, wherein, FIG. 5 shows a perspective view of the second embodiment of the breast massage device of the present invention; FIG. 6 shows an exploded and perspective view of the second embodiment of the breast massage device of the present invention; FIG. 7 shows an exploded and lateral view of the second embodiment of the breast massage device of the present invention; and FIG. 8 is a cross-sectional view of the second embodiment of the breast massage device of the present invention. As illustrated, the breast massage device of the present invention includes a main body 10A, a drive unit 20A, a transmission gear set 30A, a rotary base 40A, a plurality of massage elements 50A, a plurality of light sources 60A and a massage disk 70A.

The main body 10A includes a bottom part 11A defining a bottom chamber and an upper part 12A that is disposed securely above the bottom part 11A and that defines an upper chamber.

The drive unit 20A is installed in the bottom chamber of the bottom part 11A, includes a motor 21A having a drive shaft 211A, a drive axle 22A sleeved securely on the drive shaft 211A.

The transmission gear set 30A has a lower gear part 31A extending into the bottom chamber in such a manner so as to be engaged with the drive axle 22A so that the lower gear part 31A is driven upon activation of the motor 21A. The gear set 30A further has an upper gear part 32A extending into the upper chamber of the upper part 12A.

The rotary base 40A is disposed rotatably in the upper chamber, and has at least one driven wheel 41 formed on a lower side surface thereof and engaged with the upper gear part 32A of the gear set 30A such that the rotary base 40A is driven upon activation of the motor 21A. Preferably, the rotary base 40A is shaped like a circular disk in this embodiment. The upper side surface of the rotary base 40A is formed with at least one retention recess 42A, a light-retention plate 43A and a spring holding recess 44A located interior of the retention recesses 42A.

The plurality of massage elements 50A are disposed rotatably within the retention recesses 42A of the rotary base 40A. Each of the massage elements 50A is shaped like a ball. In order to enhance the massage effects of the massage elements 50A, the materials for construction of the massage elements 50A are selected from a group consisting of titanium, germanium, magnetic stone, Nano, infrared-emitting substance and ceramics. The massage device of the present invention further includes a plurality of biasing elements (springs) disposed within the retention recesses 42A respectively beneath the massage elements 50A for resiliently cushioning the massage elements 50A.

The plurality of light sources 60A are mounted on the light-retention plate 43A. In this embodiment, Light Emitting Diodes (LED) serve as the light sources 60A.

The massage disk 70A is disposed in the upper chamber above the rotary base 40, has a lower portion fastened securely with the rotary base 40 such that the massage disk 70 and the rotary base 40 are driven simultaneously upon activation of the motor 21. As illustrated, the massage disk 70A has a concave surface that is used for covering a user's breast and that has the same structure described previously. Resilient transparent or semi-transparent materials can be selected for forming the massage disk 70A. The massage disk 70A is preferably formed with a plurality of exposure holes 71A via which the massage elements 50A are exposed to an exterior of the massage disk 70A so as to provide massage actions. The massage disk 70A is further formed with a spring hole 72A in alignment with the spring holding recess 44A of the rotary base 40A.

A sphere shaped block 80A is disposed above the spring holding recess 44A of the rotary base 40A while a spring unit 81A is disposed within the spring holding recess 44A so as to bias the sphere shaped block 80A protruding outwardly via the spring hole 72A, thereby providing a resilient massage action upon rotation of the massage disk 70A (see FIG. 6).

Similar to the first embodiment, the breast massage device of the present invention further includes a plurality of heat generating elements and circuits disposed below the massage disk 70A. Preferably, thermistor, filaments, bulbs can serve as the heat generating elements which become hot upon passage of current through the circuits so as to generate thermal heat at the tips of the massage elements or the protrusions so as to warm up the user's breasts and at the same time providing massage actions to the user's breasts.

In the previous two embodiments, the massage disk 70, 70' or 70" of the present invention are driven upon activation of the drive unit such that rotation of the massage disk 70, 70' or 70" provide waveform massage actions on the breasts owing to the asymmetric inclination structure of the two portions of the concave surface, thereby resulting in rubbing, kneading and pinching massage actions relative to the breasts covered by the concave surface of the massage disk 70, 70' or 70".

Figure 9:
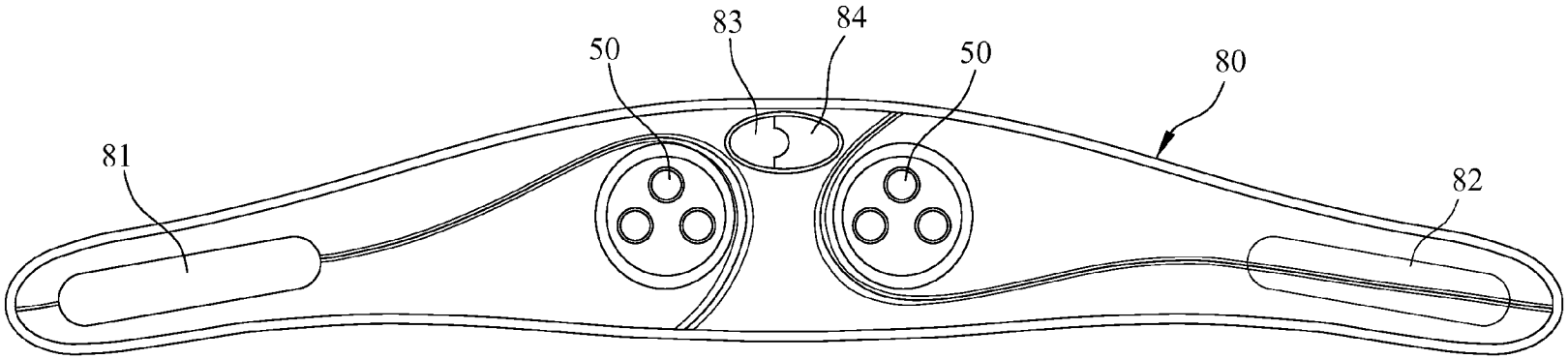
FIG. 9 illustrates the breast massage device of the present invention mounted on a carrier device.

FIG. 9 illustrates the breast massage device of the present invention mounted on a carrier device. Preferably, the carrier device 80 is a brassier having two breast cups for respectively holding the breasts of the wearer and two fastening straps. Two fastening means 81, 82 are attached to the breast cups of the brassier in a known manner to hold two massage devices of the present invention prior to wearing the brassier. Preferably, two press buttons or two pieces of Velcro straps can serve as the fastening means 81, 82.

Figure 10:
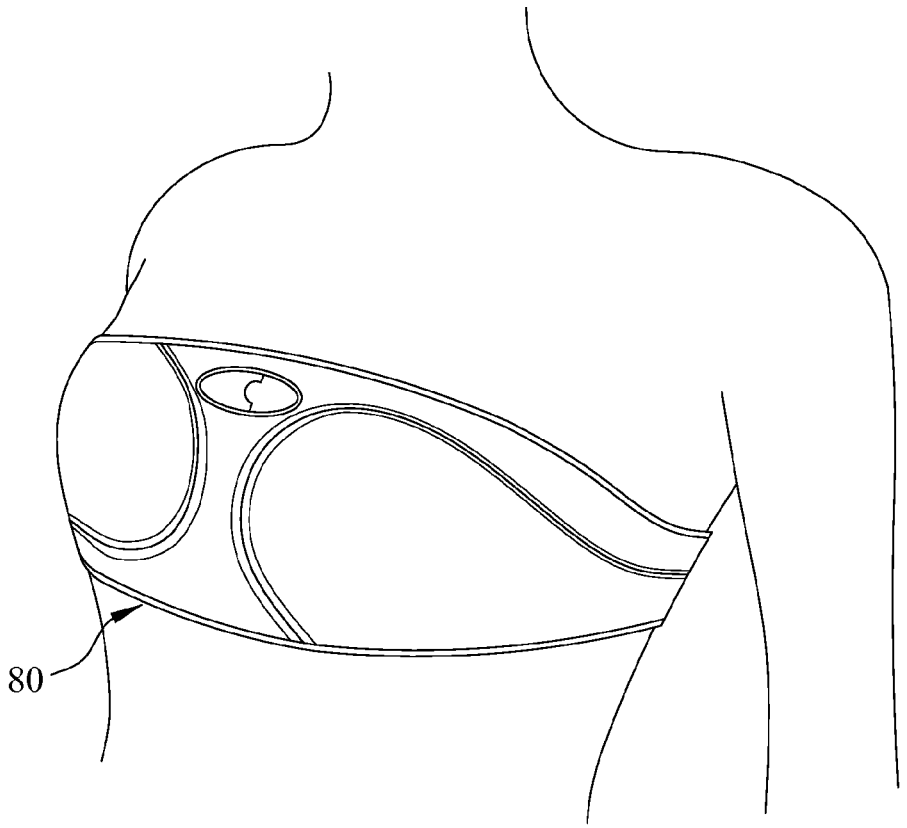
FIG. 10 illustrates how the breast massage device of the present invention is worn on a user via the carrier device.

It is to note that the brassier should also be provided with a power source 83 and a regulator 84 so that power can be supplied to each of the massage devices of the present invention for activating the motors thereof and the regulator 84 is used for adjusting rotation speed of the motors in order to provide the desired massage actions. FIG. 10 illustrates how the breast massage device of the present invention is worn on a user via the carrier device.

Referring again to FIG. 1A, a handle or a handgrip 9 can be installed to the bottom part 11 of the main body 10 to facilitate handling of the massage device of the present invention. Preferably, the handgrip should be curved ergonomically in such a manner to facilitate covering of the massage disk 70 on the user's breast. Other forms of handgrip can be utilized so long as they can achieve the purpose of properly covering the user's breast prior to activation of the massage device of the present invention.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A breast massage device comprising:

a main body;

a drive unit installed within said main body; and a massage disk mounted on said main body and coupled with said drive unit so as to be driven rotatably thereby, said massage disk having a central axis, a concave surface for covering a user's breast, a periphery confining said concave surface and a plurality of massage elements mounted rotatably on said concave surface such that said massage elements are rotatable relative to said concave surface upon activation of said drive unit;

wherein said periphery has a highest point and a lowest point located at two opposite sides of said central axis such that a first portion of said concave surface extending from said highest point toward said central axis is longer in curved distance than a second portion of said concave surface extending from said lowest point to said central axis.

2. The breast massage device according to claim 1, wherein each of said massage elements is shaped like a ball.

3. The breast massage device according to claim 1, further comprising a plurality of biasing elements disposed beneath said massage elements for resiliently cushioning said massage elements.

4. The breast massage device according to claim 1, further comprising a plurality of heat generating elements and circuits disposed below said massage disk.

5. The breast massage device according to claim 1, further comprising a carrier device via which the breast massage device is adapted to be worn by a user.

6. The breast massage device according to claim 5, wherein a brassier serves as said carrier device.

7. A breast massage device comprising:

a main body;

a drive unit installed within said main body; and a massage disk mounted on said main body and coupled with said drive unit so as to be driven rotatably thereby, said massage disk having a central axis, a concave surface for covering a user's breast, a periphery confining said concave surface and a plurality of protrusion elements disposed stationarily on said concave surface and extending annularly around said central axis such that each of said protrusion elements is curved and protruded outward from said concave surface and has a narrow first end and a large second end, which increases gradually in height, width and surface area from said narrow first end towards said large second end;

wherein said periphery has a highest point and a lowest point located at two opposite sides of said central axis such that a first portion of said concave surface extending from said highest point toward said central axis is longer in curved distance than a second portion of said concave surface extending from said lowest point to said central axis.

8. The breast massage device according to claim 7, wherein said massage disk defines an eccentric axis, and two of said protrusion elements are disposed stationarily on said concave surface and extending annually around said eccentric axis.

9. The breast massage device according to claim 7, further comprising a carrier device via which the breast massage device is adapted to be worn by a user.

10. The breast massage device according to claim 9, wherein a brassier serves as said carrier device.

* * * * *